US006405952B1

(12) United States Patent
Zoz

(10) Patent No.: US 6,405,952 B1
(45) Date of Patent: Jun. 18, 2002

(54) SUPERFINE MILLING APPARATUS WITH PIVOTAL MILLING CHAMBER

(75) Inventor: Henning Zoz, Freudenberg (DE)

(73) Assignee: Zoz GmbH, Wenden (DE)

( * ) Notice: Subject to any disclaimer, the term of this patent is extended or adjusted under 35 U.S.C. 154(b) by 0 days.

(21) Appl. No.: 09/535,478

(22) Filed: Mar. 24, 2000

(30) Foreign Application Priority Data

Mar. 24, 1999 (DE) ..... 199 13 243

(51) Int. Cl.[7] ..... B02C 17/14
(52) U.S. Cl. ..... 241/172
(58) Field of Search ..... 241/171, 172, 241/177

(56) References Cited

U.S. PATENT DOCUMENTS 1,772,737 A * 8/1930 Wise et al. ..... 241/177
4,730,789 A * 3/1988 Geiger ..... 241/172
4,936,513 A * 6/1990 Smith ..... 241/172
5,464,163 A 11/1995 Zoz
6,019,300 A 2/2000 Zoz

* cited by examiner

*Primary Examiner*—Mark Rosenbaum
(74) *Attorney, Agent, or Firm*—Herbert Dubno; Andrew Wilford

(57) ABSTRACT

A high-energy/superfine milling apparatus has a milling vessel having a side wall centered on a vessel axis, defining a closed compartment, having a pair of end walls, and formed with a closable fill/empty port. An agitator rotatable about the vessel axis in the compartment has a shaft extending through one of the end walls and a plurality of arms projecting generally radially from the shaft. A drive motor adjacent the vessel and connected to the shaft rotates the agitator in the vessel about the vessel axis. The vessel, agitator, and drive motor are supported on a stationary frame for pivoting about a frame axis transverse to the vessel axis between an upright position with the vessel axis generally vertical and a horizontal position with the vessel axis generally horizontal.

9 Claims, 12 Drawing Sheets

SUPERFINE MILLING APPARATUS WITH PIVOTAL MILLING CHAMBER

FIELD OF THE INVENTION

The present invention relates to a high-energy super-fine milling apparatus. More particularly this invention concerns such an apparatus intended to reduce particles to the nanometer range.

BACKGROUND OF THE INVENTION

A standard such high-energy and/or superfine miller, also known as an attritor, has a milling vessel having a side wall centered on a vessel axis, defining a closed compartment, having a pair of end walls, and formed with a closable fill/empty port. An agitator rotatable about the vessel axis in the compartment has a shaft extending through one of the end walls and a plurality of arms projecting generally radially from the shaft. A drive motor adjacent the vessel and connected to the shaft rotates the agitator in the vessel about the vessel axis. The vessel is supported on a stationary frame. Such devices are used to reduce particulate material to extreme fineness for producing paint, alloying powder, and materials used in the semiconductor industry.

The standard prior-art system has the vessel mounted upright, with the vessel axis vertical. Filling such a system through the upper wall is particularly easy but it has the disadvantage of producing particles of nonuniform size. The kinetic energy of the agitator is effective perpendicular to gravity. Thus the distribution of the bodies being milled which have a relatively great mass is in part determined by gravity so that the kinetic density decreases from the bottom to the top of the load. This effect is particularly troublesome with wet milling, when liquid is added to the bodies being milled, since the liquid increases the mass being moved.

Accordingly commonly owned U.S. Pat. No. 5,464,163 describes such a milling apparatus having a milling vessel forming a milling chamber having a horizontal axis and adapted to receive a loose filling of milling bodies and a bearing-and-seal unit defining an end wall of the chamber, centered on the axis and provided with a shaft seal and a journal bearing. This bearing-and-seal unit has means enabling a number of different milling vessels to be juxtaposed with the bearing-and-seal unit. A shaft rotatable about the axis and sealed relative to the milling vessel by the shaft seal is journaled for rotation in the journal bearing. A rotor connected to the shaft and disposed in the milling vessel is formed with agitator elements imparting intensive movement to the bodies of the filling upon rotation of the shaft.

Another such horizontal axis machine is described in commonly owned U.S. Pat. 6,019,300 which has inlet and outer fittings open tangentially into a generally cylindrical milling vessel containing a charge of loose milling bodies. Gas flow through the vessel can alternate in velocity and the rotor speed can alternately pass from a relatively high speed to a relatively low speed.

Both these arrangements have certain advantages. Principally they produce a very uniform product, that is with a particle size lying in a very narrow range. Nonetheless it has been determined the high kinetic energy of the system is disadvantageous when working with sensitive materials. Furthermore emptying and filling the device is quite difficult, especially in a wet-milling system.

OBJECTS OF THE INVENTION

It is therefore an object of the present invention to provide an improved high-energy/superfine milling apparatus.

Another object is the provision of such an improved high-energy/superfine milling apparatus which overcomes the above-given disadvantages, that is which produces a highly uniform product even when working with sensitive materials, yet which is easy to fill and use, even for wet-milling.

SUMMARY OF THE INVENTION

A high-energy/superfine milling apparatus has according to the invention a milling vessel having a side wall centered on a vessel axis, defining a closed compartment, having a pair of end walls, and formed with a closable fill/empty port. An agitator rotatable about the vessel axis in the compartment has a shaft extending through one of the end walls and a plurality of arms projecting generally radially from the shaft. A drive motor adjacent the vessel and connected to the shaft rotates the agitator in the vessel about the vessel axis. In accordance with the invention the vessel, agitator, and drive motor are supported on a stationary frame for pivoting about a frame axis transverse to the vessel axis between an upright position with the vessel axis generally vertical and a horizontal position with the vessel axis generally horizontal.

With the milling apparatus according to the invention it is possible to dry- and wet-mill, respectively in the horizontal and vertical positions. The system allows simple milling, intensive mixing, dispersing, as well as mechanical alloying, high-energy milling, and reactive milling under wet and dry conditions with one and the same apparatus. It is possible to control the energy input to the vessel extremely accurately so that particularly sensitive materials that must have a particularly homogenous particle geometry and size can be produced with excellent results. The prior-art problems in mixer-type ball mills when producing pigments are largely avoided.

According to the invention the vessel is pivotal with the agitator and drive motor between the upright position and a pair of oppositely offset angled positions. More particularly the means for pivoting oscillates the vessel, agitator, and drive motor back and forth about the frame axis between the pair of offset angled positions that are offset by about 45° to vertical. Highly sensitive metallic flakes, for instance of platinum, silver, or tantalum, can thus be produced since they will not drop to the bottom as in a standard vertical system. To allow this, the vessel is provided at its center of mass with a horizontal pivot shaft lying on and defining the frame axis.

In accordance with the invention a guide on the frame allows displacement displacing at least the other end wall and side wall of the vessel between an upper position and a lower position therebelow. In the lower position the other end wall and side wall are separated from the one end wall, drive motor, and agitator. In addition a gripper is provided for holding the one end wall, drive motor, and agitator on the frame above the other end wall and side wall in the lower position thereof. In addition the other end wall and side wall are tippable about a horizontal axis in the lower position. Thus the drive and agitator assembly, along with the one end wall, can be held while the side wall and other or bottom wall are lowered. Once lowered the vessel can be dumped out or exchanged with another vessel. A seal is provided between the one end wall and a rim of the side wall and releasable clamps allow the one end wall to be hermetically secured to the side-wall rim. Even if the system is used for horizontal-axis milling, the ability to turn it on end and set down the vessel makes loading and unloading it very easy.

BRIEF DESCRIPTION OF THE DRAWING

The above and other objects, features, and advantages will become more readily apparent from the following description, reference being made to the accompanying drawing in which.

SPECIFIC DESCRIPTION

Figure 6B:
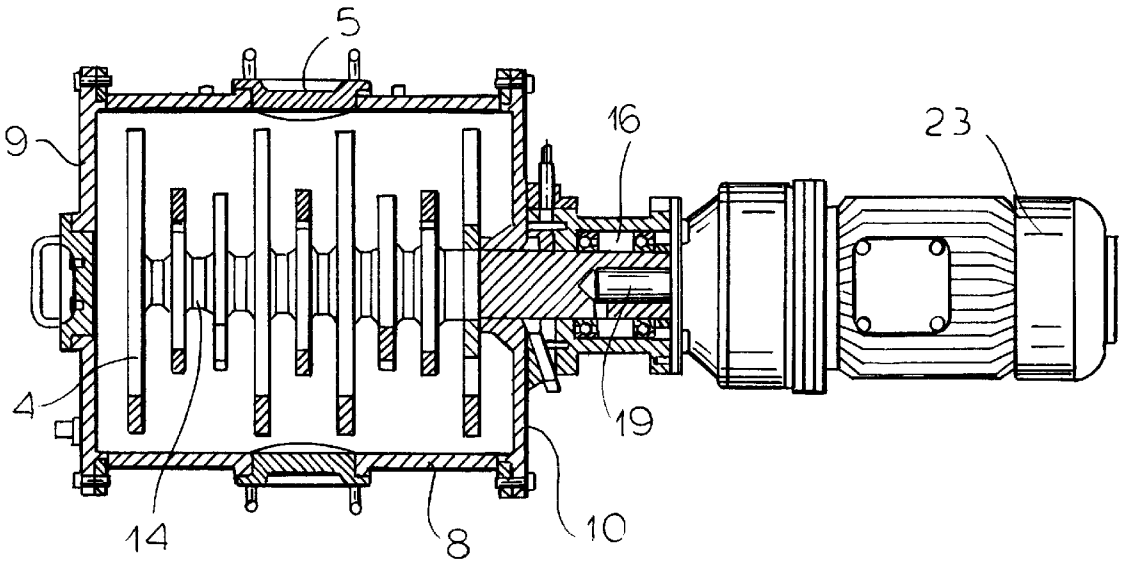
FIGS. 6*a* and 6*b* are cross and longitudinal sections through the vessel in somewhat larger scale.
Figure 6A:
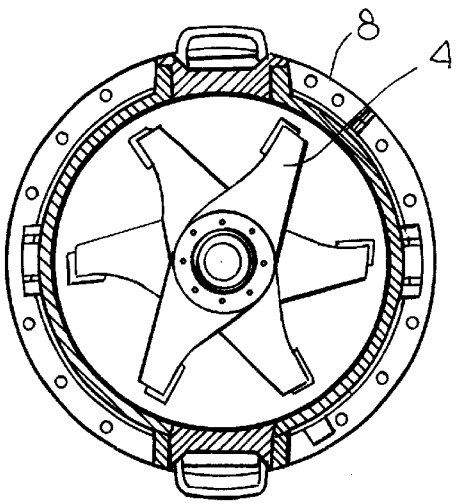
Figure 6D:
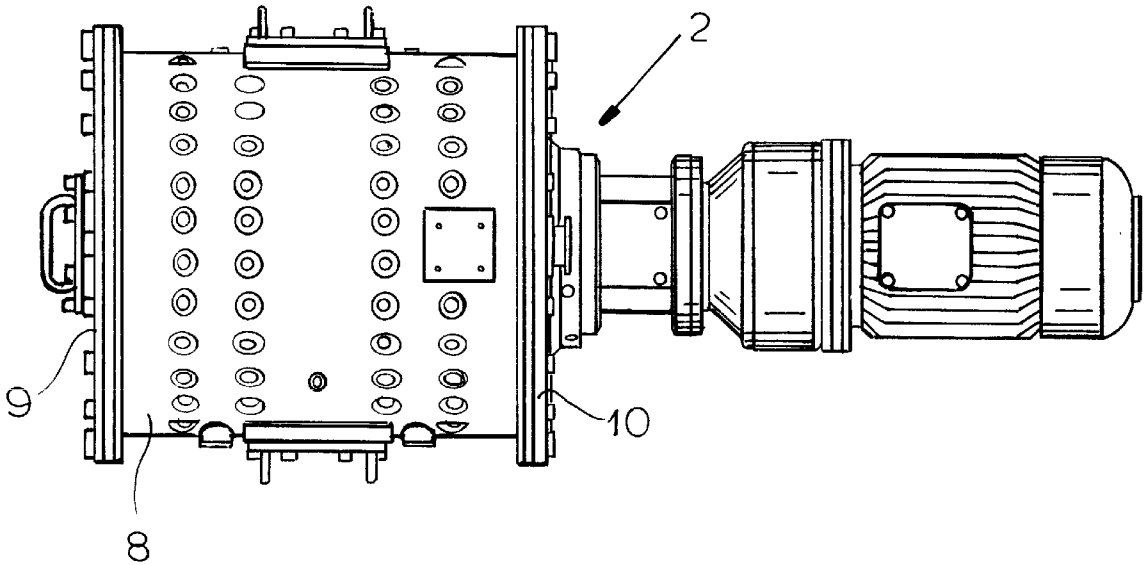
FIGS. 6*c* and 6*d* are end and side views corresponding to FIGS. 6*a* and 6*b;*
Figure 6C:
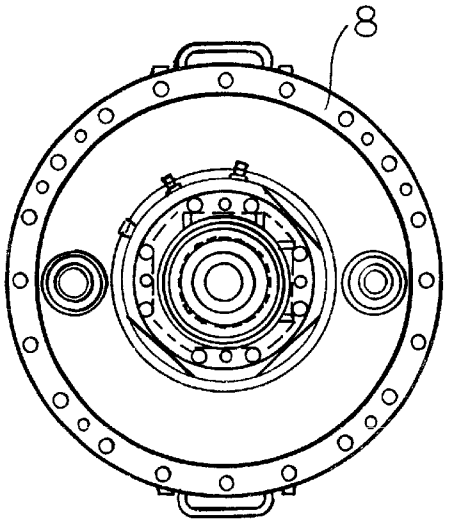
Figure 7B:
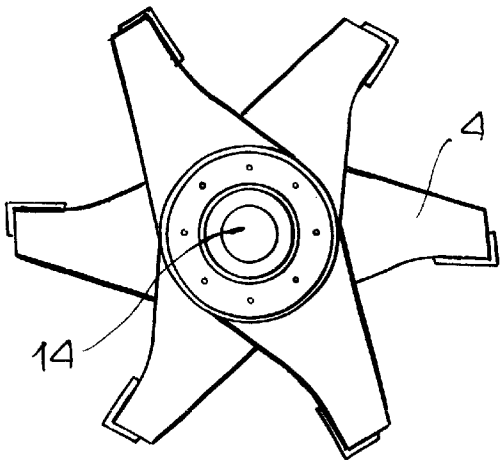
FIGS. 7*a* and 7*b* are side and end views of the agitator.
Figure 7A:
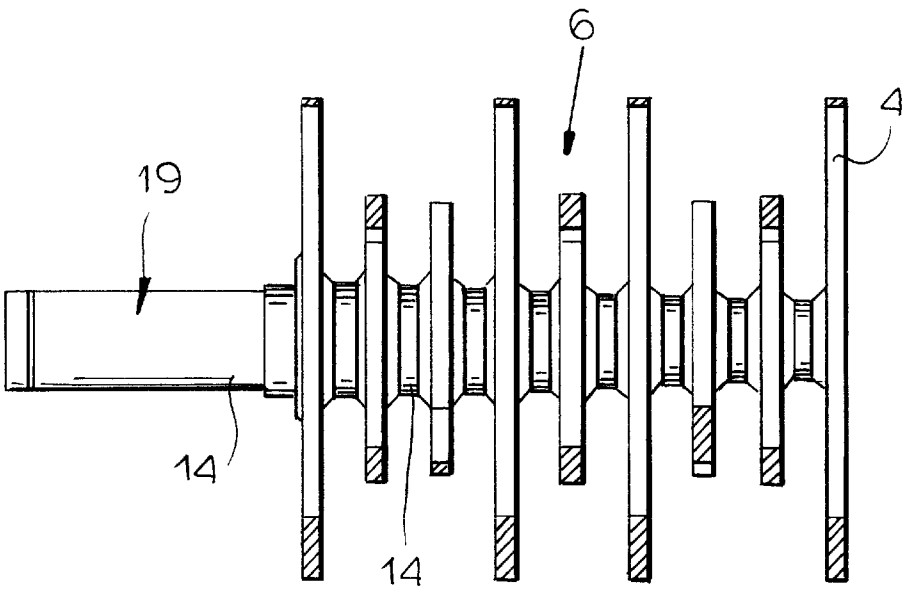
Figure 7E:
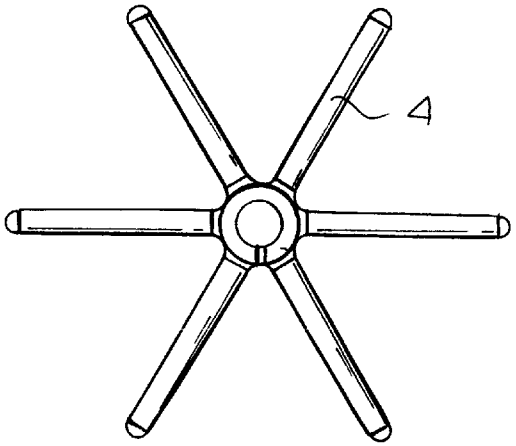
FIG. 7*e* is an end view of the agitator of FIGS. 7*c* and 7*d*.
Figure 7D:
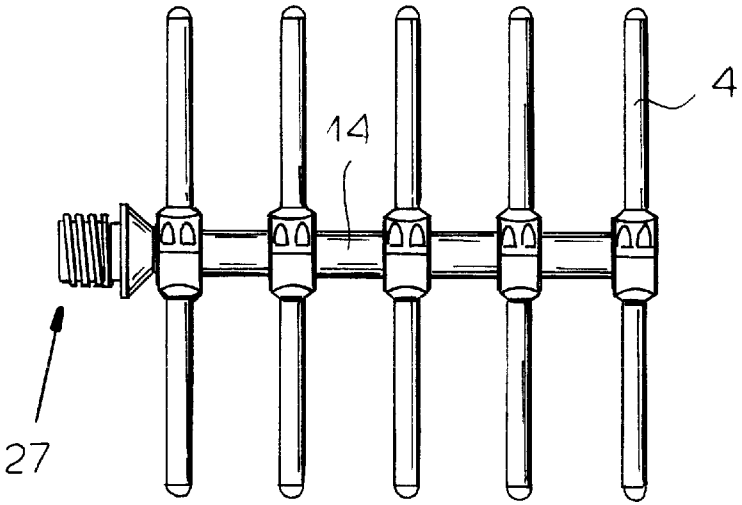
FIG. 7*c* and 7*d* are side views of part of another agitator according to the invention.
Figure 7C:
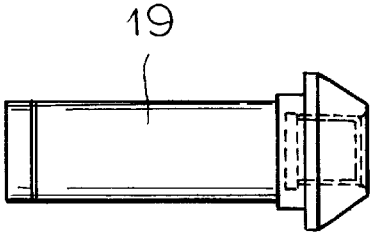

As seen in the drawing, a high-energy and/or superfine milling apparatus 1 has a vessel 2 with a cylindrical side wall 8 centered on an axis 2A and planar end walls 9 and 10 perpendicular to this axis 2A. The side wall 8 is provided with an openable and closable fill port 5. An agitator 6 inside the vessel 2 has a shaft 14 (FIG. 2*b*) extending along the axis 2A and through the wall 10 and carrying a plurality of radially projecting arms 4 that are spaced along the full length of the compartment formed by the vessel 2. A drive motor 23 coaxial with the agitator 6 has an output shaft 19 (FIG. 7*c*) extending through a bearing 16 (FIG. 6*b*) in the end wall 10 and is connected to the agitator shaft 14 to rotate the agitator 6 at high speed about the axis 2A. The arms 4 can be plate-like as shown in FIGS. 7*a* and 7*b*. Alternately as shown in FIGS. 7*c*, 7*d*, and 7*e* the shaft 14 can carry rod-like arms 4. Either way a-threaded connection 27 is provided between the agitator shaft 14 and the motor output shaft 19

A pair of stub shafts 12 project diametrically oppositely from the side wall 8 at about the, center of mass of the assembly formed by the vessel 2 and drive motor 23 and have outer ends seated in journal blocks 25 carried on chains 26 moveable in guides 24 on upright legs 22 of a frame 7 supported via feet 20 on the ground. A controller 21 for the motor 23 sits on the frame 7 just above the feet 20.

Figure 1B:
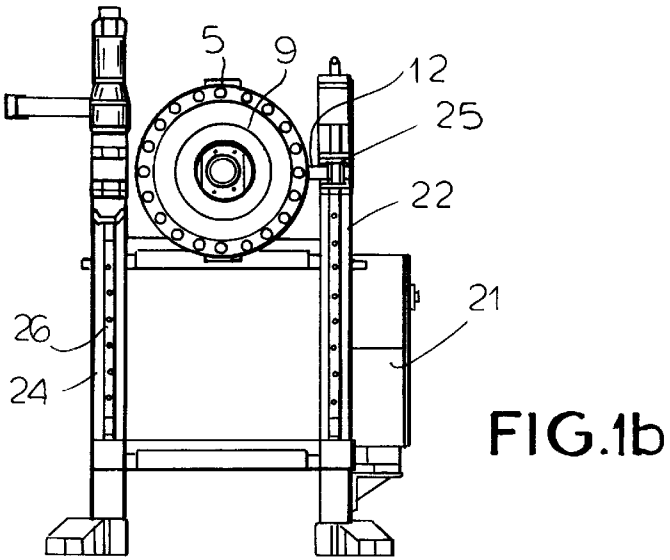
FIGS. 1*a*, 1*b*, and 1*c* are side, end, and top views of the apparatus according to the invention in the horizontal milling position.
Figure 1A:
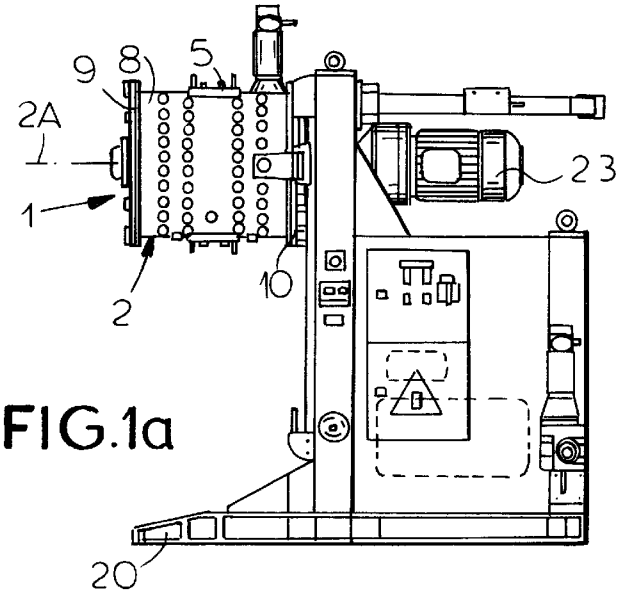
Figure 1C:
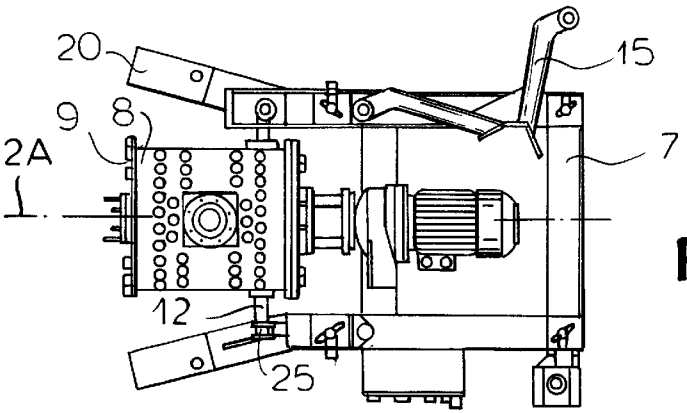
Figure 2B:
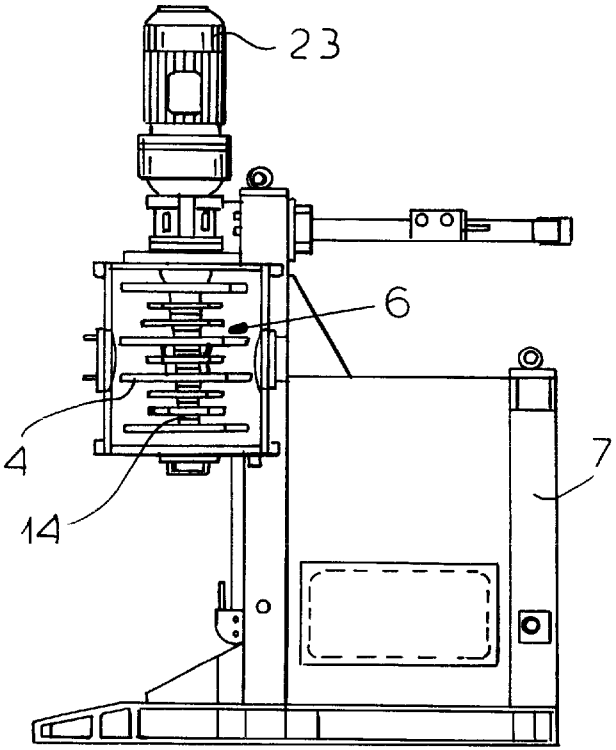
FIGS. 2*b*, 2*c*, and 2*d* are partly sectional side, end, and top views showing the apparatus according to the invention in the vertical milling position.
Figure 2A:
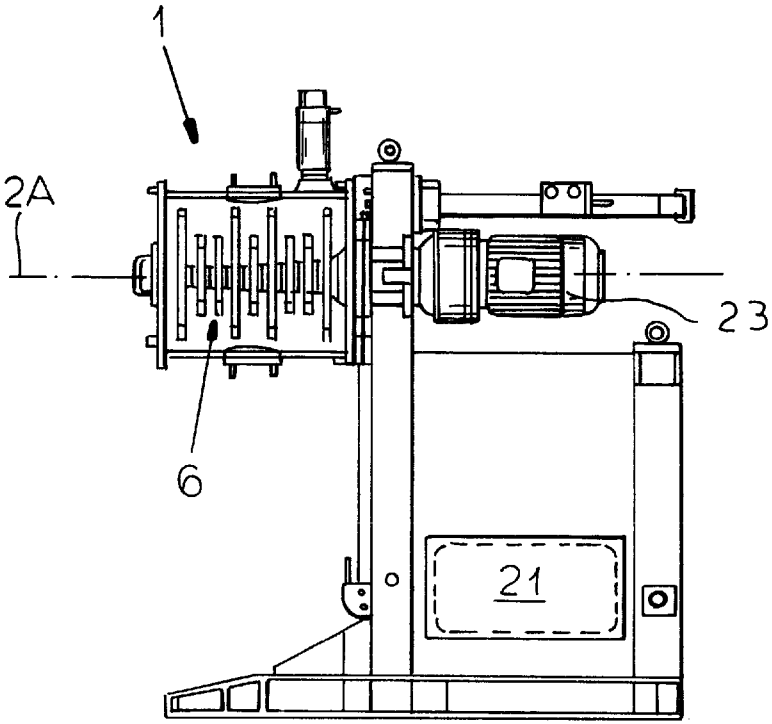
FIG. 2*a* corresponds to FIG. 1*a* but is partly in section.
Figure 2D:
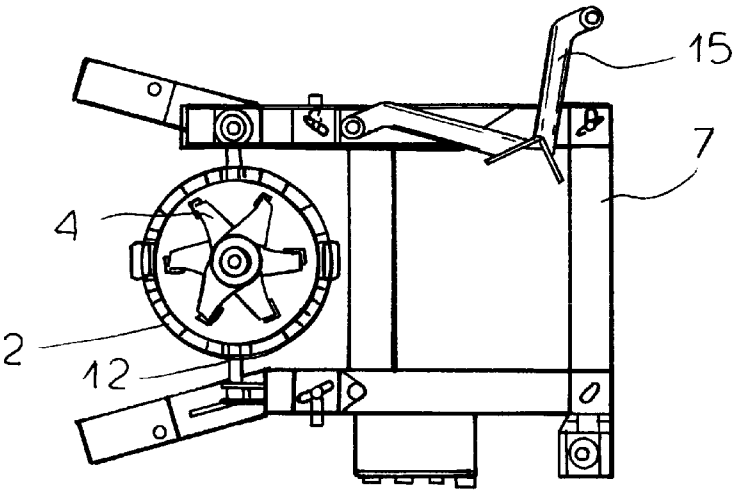
Figure 2C:
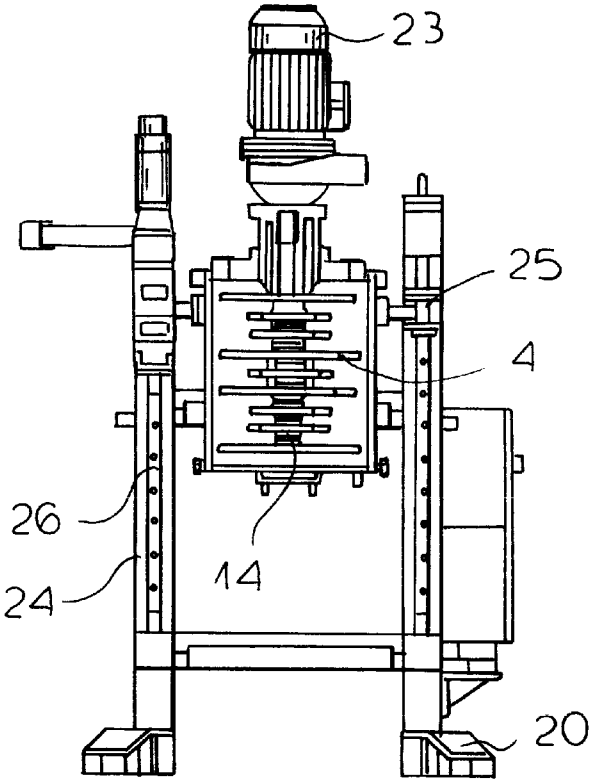
Figure 3B:
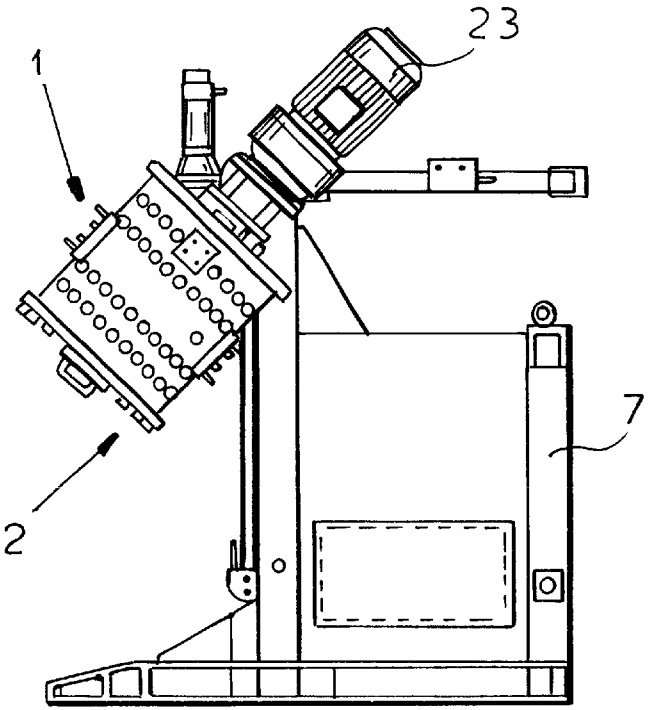
FIGS. 3*b* and 3*c* show the system in two angularly offset end positions during oscillation.
Figure 3A:
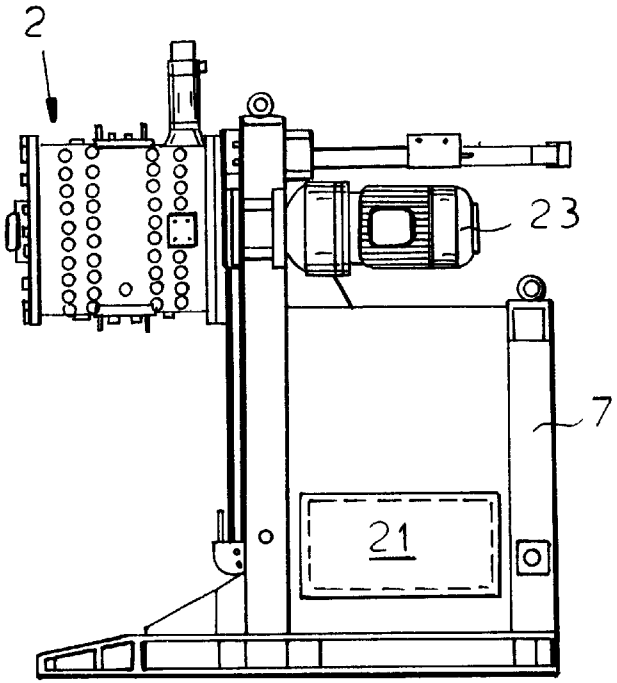
FIG. 3*a* corresponds to FIG. 1*a;*
Figure 3D:
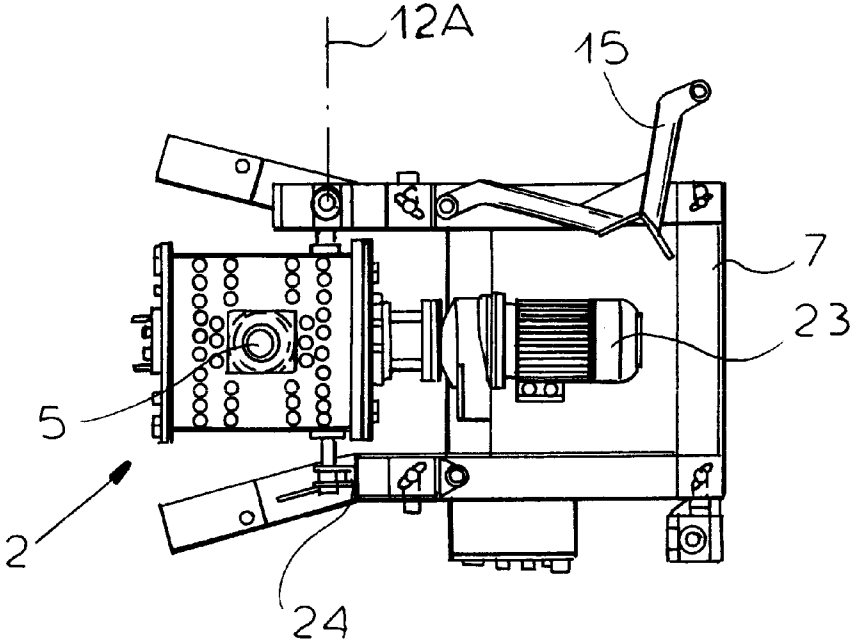
FIG. 3*d* corresponds to FIG. 1*c;*
Figure 3C:
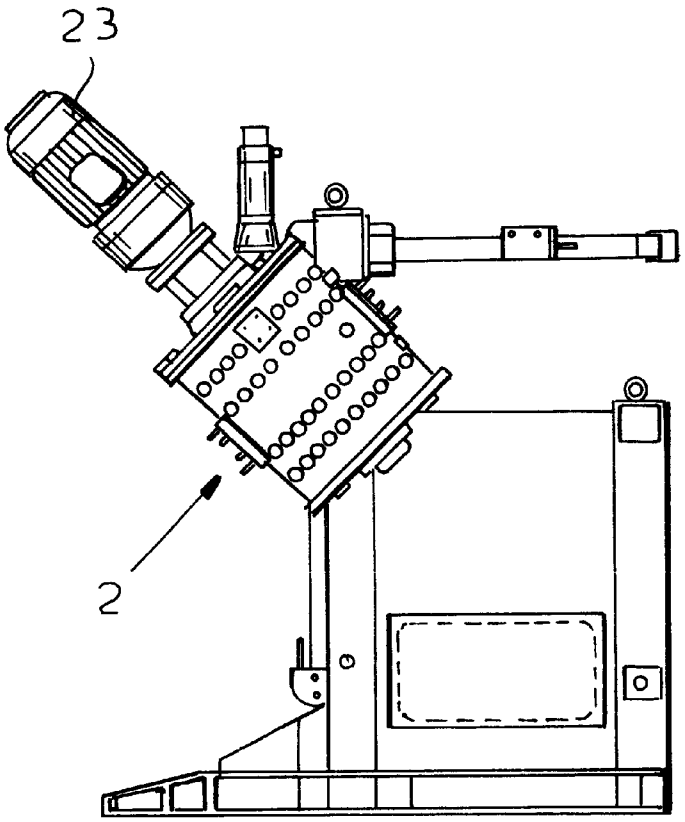
Figure 4B:
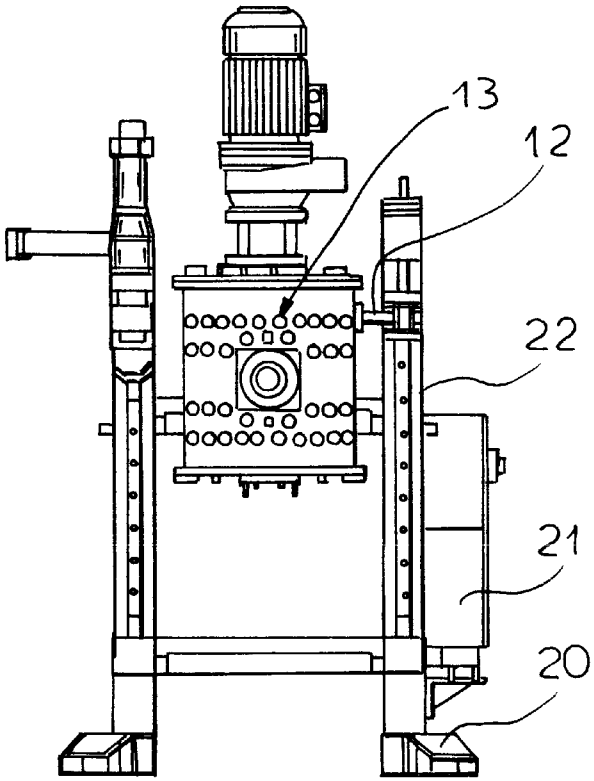
FIGS. 4*a*, 4*b*, and 4*c* are side, end, and top views in the vertical milling position.
Figure 4A:
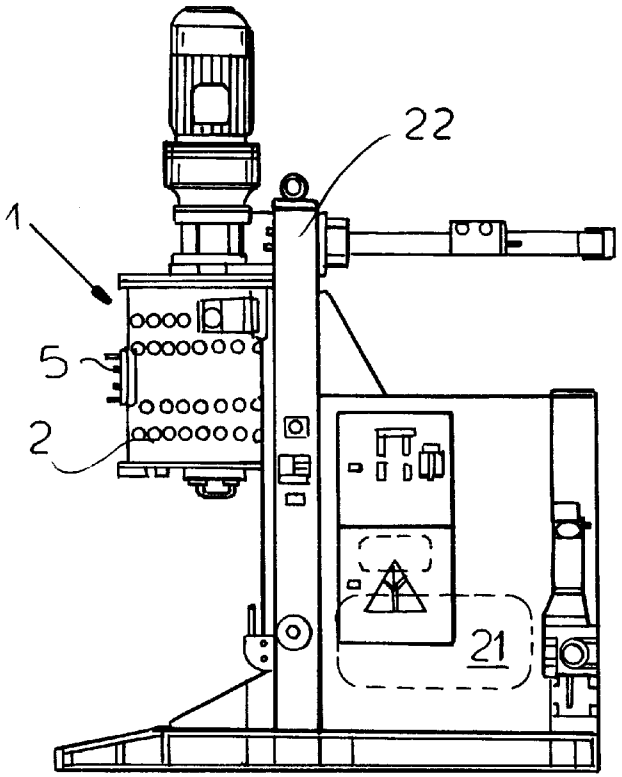

According to the invention the vessel 1 can be operated in the horizontal position of FIGS. 1*a*, 1*b*, 1*c*, 2*a*, 3*a*, and 3*d*, typically for a dry-milling operation. It can also be operated in a vertical position as shown in FIGS. 2*b*, 2*c*, and 2*d*, for instance for wet milling. It also lies within the scope of this invention to oscillate or rock the vessel 2 and drive motor 23 about the axis 12A between the positions of FIGS. 3*b* and 3*c* which are offset by 45° to the vertical.

Figure 5C:
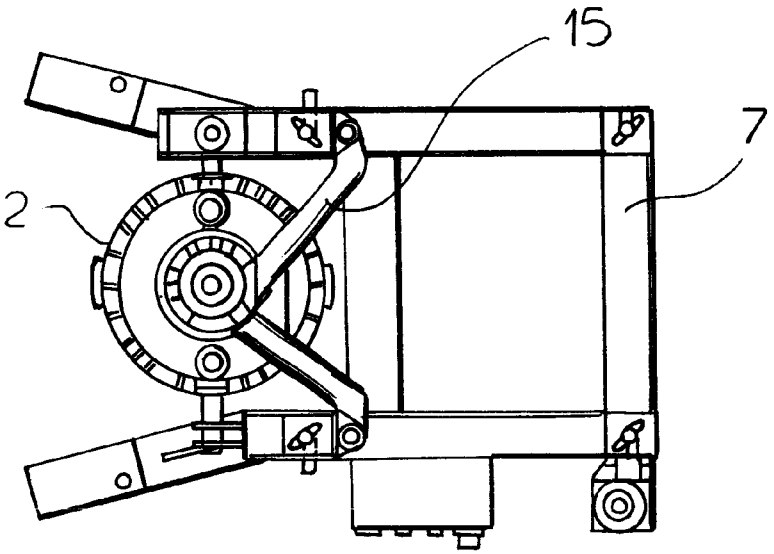
FIG. 5*a*, 5*b*, and 5*c* are side, end, and top views llustrating the apparatus with the vessel in a lower position.
Figure 4C:
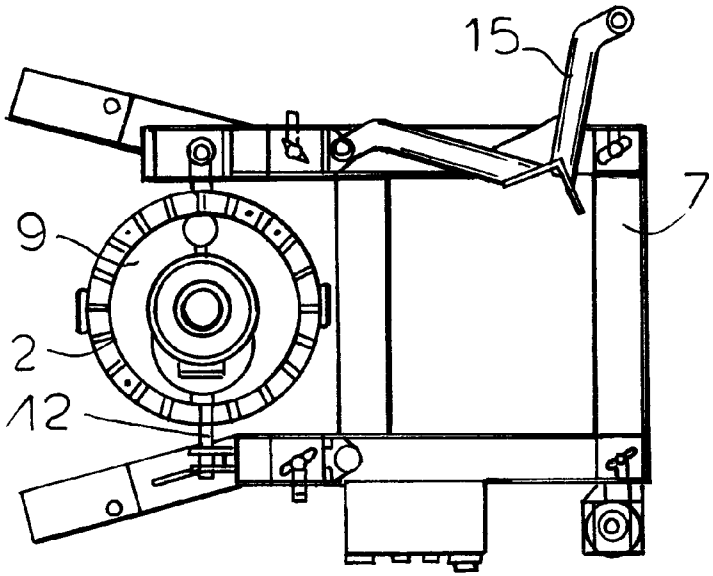
Figure 5B:
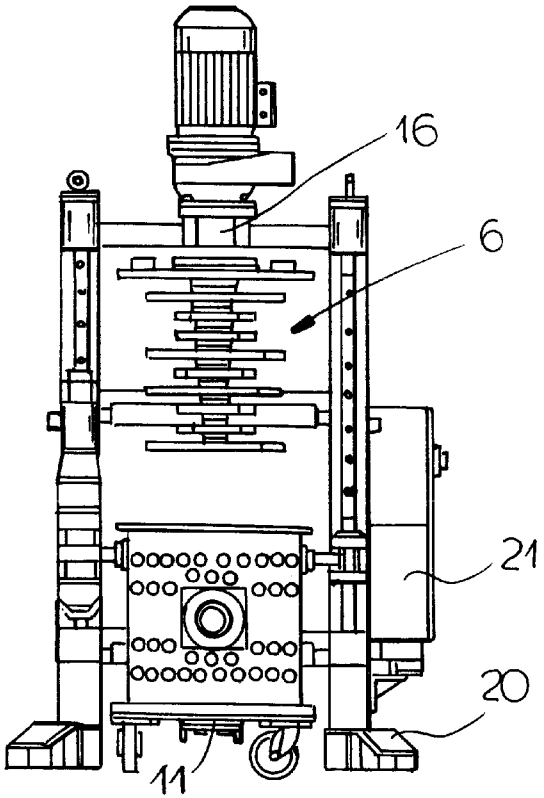
Figure 5A:
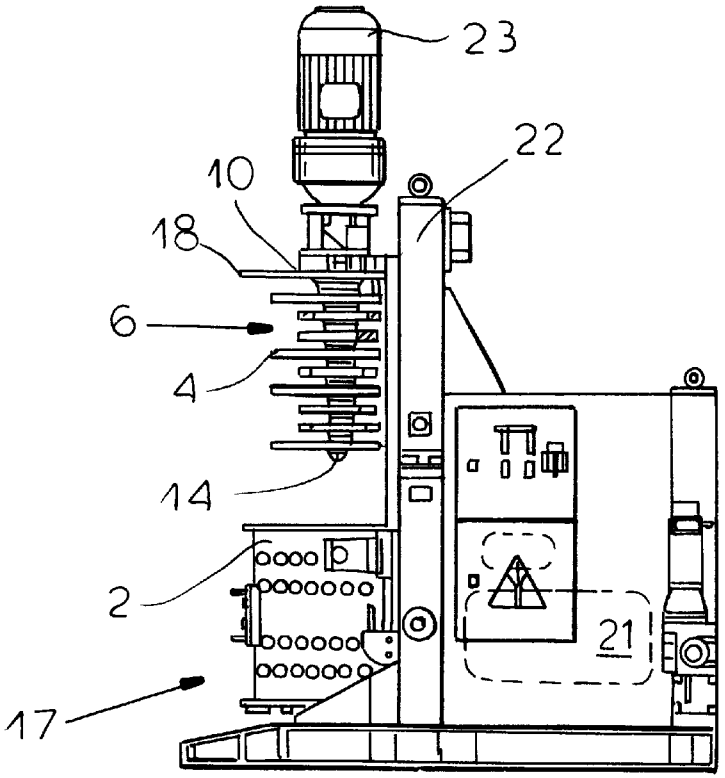

FIGS. 5*a*, 5*b*, and 5*c* show how the side wall 8 and end wall 9 can be separated from the end wall 10. To this end a seal 18 is provided between a rim of the side wall 8 and end wall 10 along with unillustrated clamps. Furthermore a gripper arm 15 pivoted on the frame 7 can be engaged with the bearing 16 to hold up the subassembly constituted by the motor 23, end wall 10, and rotor 6 while the chains 26 lower the bucket formed by the side wall 8 and end wall 9 down onto a dolly 11 between the feet 20 of the frame 7. Thus the apparatus 1 can be loaded and unloaded easily and, when the blocks 25 are separable from the chains 26, it is possible to switch out most of the vessel 2 so that there is little down time between processing of batches.

I claim:

1. A high-energy/superfine milling apparatus comprising:

a milling vessel having a side wall centered on a vessel axis, defining a closed compartment, having a pair of end walls, and formed with a closable fill/empty port;

an agitator rotatable about the vessel axis in the compartment and having a shaft extending through one of the end walls and a plurality of arms projecting generally radially from the shaft;

means including a drive motor adjacent and fixed to the vessel and connected to the shaft for rotating the agitator in the vessel about the vessel axis, the vessel, agitator, and drive motor having a center of mass;

a stationary frame;

bearing means supporting the vessel, agitator, and drive motor on the frame for pivoting on the frame jointly about a frame axis transverse to the vessel axis and passing generally through the center of mass between an upright position with the vessel axis generally vertical and a horizontal position with the vessel axis generally horizontal, and between a pair of oppositely offset angled positions offset by about 45° to opposite sides of the vertical position; and drive means connected to the vessel for oscillating the vessel, agitator, and drive motor between the offset angled positions.

2. The high-energy/superfine milling apparatus defined in claim 1, wherein the vessel is provided at center of mass with a horizontal pivot shaft lying on and defining the frame axis.

3. The high-energy/superfine milling apparatus defined in claim 1, further comprising means including a guide on the frame for displacing at least the other end wall and side wall of the vessel between an upper position and a lower position therebelow.

4. The high-energy/superfine milling apparatus defined in claim 3, wherein in the lower position the other end wall and side wall are separated from the one end wall, drive motor, and agitator.

5. The high-energy/superfine milling apparatus defined in claim 4, further comprising means for holding the one end wall, drive motor, and agitator on the frame above the other end wall and side wall in the lower position thereof.

6. The high-energy/superfine milling apparatus defined in claim 4, wherein the other end wall and side wall are tippable about a horizontal axis in the lower position.

7. The high-energy/superfine milling apparatus defined in claim 4, further comprising a seal between the one end wall and a rim of the side wall.

8. The high-energy/superfine milling apparatus defined in claim 1, wherein the side wall is generally cylindrical and the end walls are generally planar and perpendicular to the vessel axis.

9. The high-energy/superfine milling apparatus defined in claim 8, wherein the arms are spaced along a full length of the shaft in the compartment.

* * * * *